United States Patent [19]

Blackwell

[11] 4,017,223

[45] Apr. 12, 1977

[54] AXIAL THRUST ADJUSTMENT FOR DUAL SCREW-TYPE PUMP

[75] Inventor: Elliott H. Blackwell, Warren, Mass.

[73] Assignee: Houdaille Industries, Inc., Buffalo, N.Y.

[22] Filed: Mar. 24, 1975

[21] Appl. No.: 561,619

[52] U.S. Cl. ..... 418/107; 418/203

[51] Int. Cl.[2] ..... F01C 1/16; F01C 21/00; F04C 1/10

[58] Field of Search ..... 418/107, 201, 203

[56] References Cited

UNITED STATES PATENTS

| | | | |
|---|---|---|---|
| 1,218,602 | 3/1917 | Holdaway | 418/203 |
| 1,323,459 | 12/1919 | Dorr | 418/107 |
| 1,677,980 | 7/1928 | Montelius | 418/203 |
| 1,751,703 | 3/1930 | Long | 418/201 |
| 2,095,168 | 10/1937 | Burghauser | 418/203 |
| 2,590,561 | 3/1952 | Montelius | 418/203 |
| 3,057,665 | 10/1962 | Zalis | 418/201 |
| 3,161,349 | 12/1964 | Schibbye | 418/203 |
| 3,658,452 | 4/1972 | Kita | 418/203 |

FOREIGN PATENTS OR APPLICATIONS

| | | | |
|---|---|---|---|
| 890,115 | 9/1953 | Germany | 418/107 |

*Primary Examiner*—John J. Vrablik

*Attorney, Agent, or Firm*—Hill, Gross, Simpson, Van Santen, Steadman, Chiara & Simpson

[57] ABSTRACT

A dual screw-type pump is provided with a means for balancing the resultant dynamic axial thrust on the screw assemblies during operation of the pump. The resultant thrust on each assembly is absorbed in part by a circular piston on the assembly near the rear of the pump and the remainder by a thrust bearing engaged with the assembly near the front of the pump. The longitudinal position of one of the screw assemblies is selectively adjustable relative to the position of the other screw assembly to balance the thrust on the screw assemblies.

9 Claims, 8 Drawing Figures

10
15
16
17
18
19
20
23
24
27
28
29
34,50
37
42
43
45
52
54
55
56
58
59
66
82
83
84
85

AXIAL THRUST ADJUSTMENT FOR DUAL SCREW-TYPE PUMP

BACKGROUND OF THE INVENTION

1. The Field of Invention

This invention relates generally to an improvement of multiple screw-type pumps used primarily for the movement of high density fluids which can contain solid materials in suspension.

2. The Prior Art

In dual screw-type pumps, heretofore provided, the longitudinal relationship of the drive screws is non-adjustable. The longitudinal relationship is determined by the relative position of the various components making up the drive screw assemblies so the relative position is controlled by the relationship of the timing gears with respect to the shafts, and the drive screws with respect to the shafts. Without precise alignment of these various components, there is a resultant misalignment of the drive screws resulting in an imbalance in the axial thrust absorbed by the respective screw assemblies.

SUMMARY OF THE INVENTION

In accordance with this invention there are two screw assemblies, a drive screw and a driven screw. Each screw assembly comprises a shaft, a piston permanently fixed near the rear of the shaft, a drive screw portion, and a timing gear permanently fixed to the shaft near the front end of the shaft.

The longitudinal position of the respective screw assemblies can float between two outer limits. The in-flow movement is limited to the interference of the piston with a surface in the rear head assembly of the pump, and the counter-flow is limited by the interference of the timing gear with a thrust bearing located in the front head assembly of the pump.

During operation under load the screw assemblies are caused to move in a counter-flow direction by the resultant axial thrust created by the movement of the fluid through the pump. This resultant thrust is absorbed in part by the front surface of the piston which acts against the fluid in the pump and a resultant force from a pressure drop around the piston. The remainder of the thrust is absorbed by the thrust bearings engaged with the timing gears.

The thrust absorbing pistons are fitted into two cylinder areas in the rear head assembly. There is sufficient clearance to allow some by-pass of the fluid medium around the piston. The material, which does by-pass, is returned to the suction inlet of the pump by means of a series of passageways in the rear head assembly. Because of this return means, there is a pressure drop between the front of the piston and the rear of the piston substantially equal to the pressure differential between the inlet and outlet of the pump. This pressure drop produces a resultant in-flow axial force. The rear head assembly also provides a bearing support area for the rear ends of the shafts of the drive screw assembly and the driven screw assembly respectively.

A front head assembly provides a means for supporting a thrust bearing and support bearing for driven screw assembly. In addition, the front head assembly provides for the adjustable disposition of a timing cartridge through which the shaft of the drive screw assembly is disposed and supported. By rotating the cartridge the relative longitudinal position of the drive screw assembly can be adjusted.

The precise longitudinal alignment between the drive screws required to obtain a balance of the resultant axial thrust on each of the screw assemblies can be achieved through the rotation of the timing cartridge which in turn adjusts the position of the drive screw, thereby obviating dependency on the precise alignment of the timing gear, the shaft, the drive screw, and the related keyway locations which control the relative locations of such components.

DESCRIPTION OF THE PREFERRED EMBODIMENT

Figures 1, 3, 4, 5, 8:
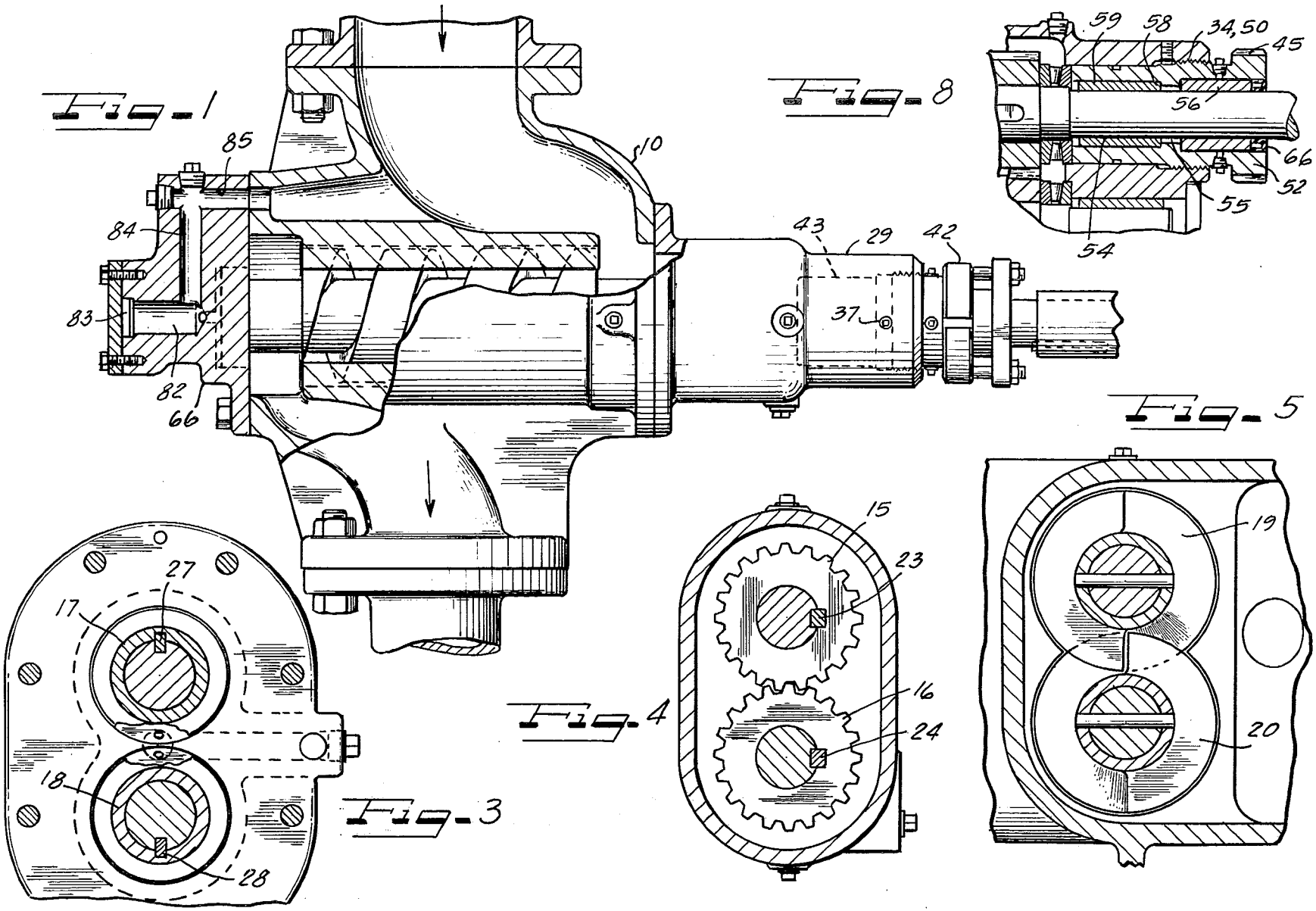
FIG. 1 is a top view of the pump assembly which includes a sectional cut of the rear portion of the pump.
FIG. 3 is a cross-sectional view through the rear portion of the pump to the rear.
FIG. 4 is a cross-sectional view through the timing gear area pump to the front.
FIG. 5 is a cross-sectional view through the drive screw area of the pump to the rear.
FIG. 8 is a cross-sectional view through the sealing portion of the pump showing an alternative configuration of the sealing means.
Figure 2:
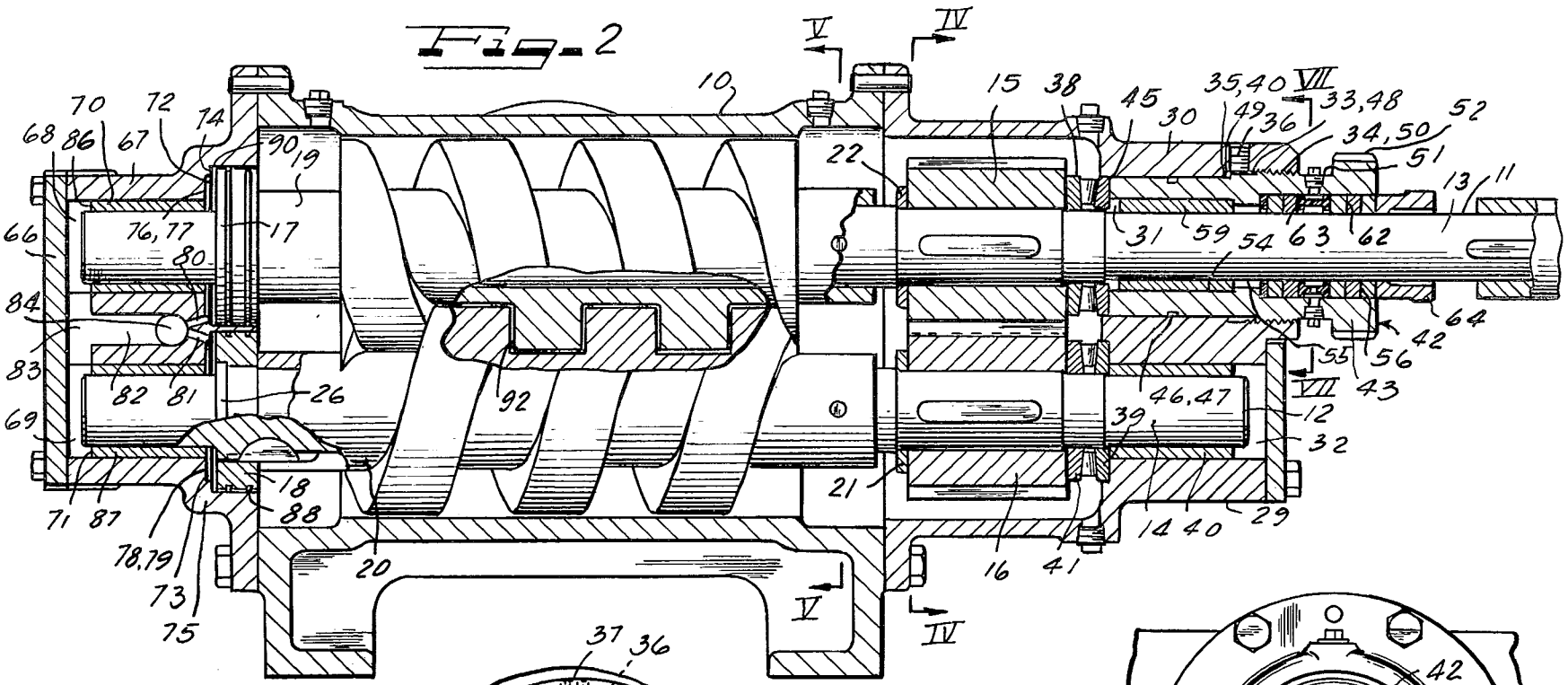
FIG. 2 is a side cross-sectional view of the pump as shown in FIG. 1.
Figure 6:
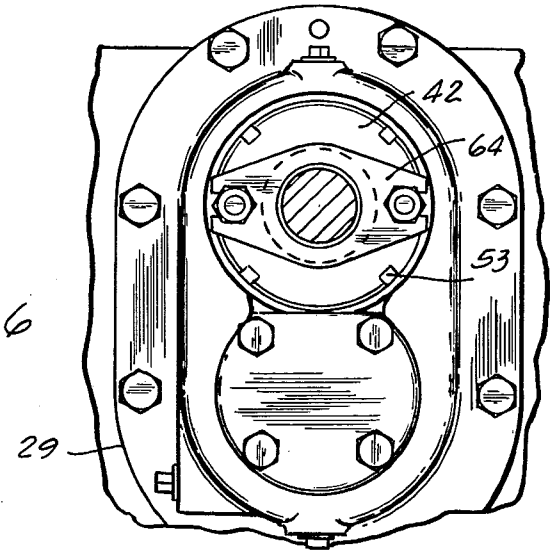
FIG. 6 is a cross-sectional view through the pump at the front of the pump.
Figure 7:
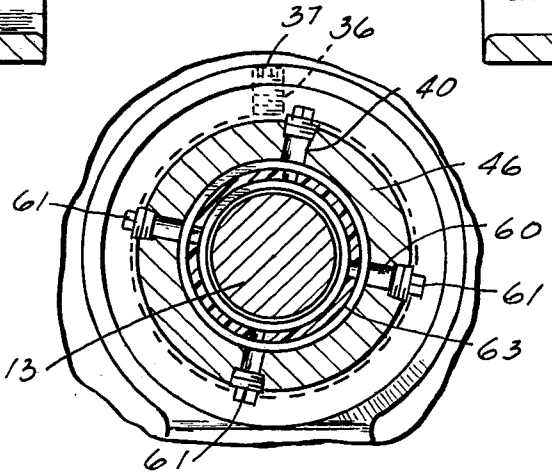
FIG. 7 is a cross-sectional view through the sealing portion of the pump.

Referring to the drawings, a dual screw-type pump is shown generally at 10. A drive screw assembly and a driven screw assembly is shown at 11, 12 respectively. Each assembly respectively comprises a shaft 13 and 14, a timing gear 15 and 16, a graphite piston 17 and 18, and drive screw 19 and 20. The position of the respective timing gears on the shaft is permanently fixed by spacer 21 and 22 and keys 23 and 24. The position of respective piston 17 and 18 is permanently fixed by offset 25 (not shown) and 26 in the shaft and keys 27 and 28, and the rear portion body of the drive screws 19 and 20.

At the forward part of the pump, a front head assembly is provided and shown generally at 29. This assembly includes a body 30 through which there is an upper and lower elongated circular passage 31 and 32 which runs parallel to the longitudinal axis of the pump. The upper passage 31 defines a rear thrustbearing support portion and a front timing cartridge support portion, and the lower passage 32 defines a second rear thrust bearing support portion, and a front sleeve bearing support portion. The rear portion of the upper passage has smooth circular walls for the slideable disposition of a thrust bearing and the timing cartridge. The forward portion is divided into two sections, a set-screw section 33 and a threaded section 34. The forward portion has a larger diameter than the rear portion so that a vertical wall is formed at the interface of the two portions. This wall defines a stop 35.

The front head assembly has a set-screw passageway 36 located at the top of the body and running perpendicular to the longitudinal axis of the pump which intersects the upper passage 31 in the set-screw section 33. A set-screw 37 is disposed in the passageway and is used to fix the position of the disposed timing cartridge once the resultant axial thrust has been balanced between the screws.

A thrust bearing 38 is disposed in rear portion of the upper passage. The rear thrust bearing support portion of the lower passage 32 has a larger diameter than the forward sleeve bearing support portion so that a vertical wall 39 is formed at the interface of the two portions. Into these portions is disposed a graphite sleeve bearing 40 and a thrust bearing 41 respectively.

A timing cartridge is shown generally at 42. This assembly has an elongated circular body 43 through which is an inner circular passage 44. The rear end of the cartridge has a vertical face 45 which engages the front vertical surface of thrust bearing 38 when the timing cartridge assembly is disposed in the upper passage 31 of the body of the front head assembly 29.

The outer surface of the timing cartridge is divided into three portions. The rear portion has a smooth surface and is provided with a groove 46 for the retention of a sealing O-ring 47. The center portion, adjacent to and to the front of the rear portion, is divided into three sections. At the rear of the center portion is a corresponding set-screw section 48. As the center portion has a larger diameter than the rear portion, a vertical wall is formed at the interface of the two portions. This wall defines a stop 49. A center section 50 of the middle portion is threaded for engagement with the thread section 34 of the upper passage and the front section 51 is a lubrication application section. A front end portion 52 is enlarged with the circumferent surface containing four tool engaging slots 53 whereby the cartridge can be rotated by a rotation force applied to the tool engagement portion through one or more of the slots 53.

The inner passage 44 of the timing cartridge is divided into three portions, a sleeve bearing support portion 54 located at the rear, a stop portion 55 in center, and a sealing portion 56 in the front. Because the center portion has a smaller diameter than the rear and front portion, a vertical wall 57, 58 is formed at the interface of the outer portions with the center portion.

A graphite sleeve bearing 59 is disposed in the rear sleeve bearing support portion 54 of the inner passage.

The cartridge body 43 is traversed by four sealable, axially converging threaded passages 60 which run perpendicular to the longitudinal area of the pump. The passages 60 are disposed at 90° intervals about the circumference of lubrication section 51 of the outer surface of the body and intersect the inner passage approximately in the middle of sealing portion 56. The outer end of each passage is sealed by a removable threaded plug 61.

The pump of the present invention may be provided as a lubricated screw pump or as a non-lubricated screw pump. In the lubricated form, the pumped fluid is allowed in contact with the timing gears while in the non-lubricated form, the timing gears are isolated by a sealing means located between the timing gears and the drive screws. It will be appreciated that the same features of the present invention are equally applicable to both forms.

In the lubricated pump and as shown in the drawings, an asbestos packing material 62 is disposed on each side of a Teflon lantern ring 63 in the forward sealing portion 58 of the inner passage of the body of the timing cartridge. The lantern ring is aligned with the four axial passages 60 whereby an introduced lubricant forms an air seal. The packaging is held in position between wall 58 and a retaining gland 64 which is removably secured to the face of the tool rotation portion 52.

In the non-lubricated form of the pump, only oil-seal 66 is disposed at the front of the sealing portion of the inner cartridge passage.

The two thrust bearings 38 and 41, the two sleeve bearings 40 and 59, the asbestos packing 62, lantern ring 63 and oil-seal 65 are prepared for the rotationable disposition of the front end of shafts 13 and 14 respectively.

At the rear of the pump, a rear head assembly is provided and shown generally at 66. This assembly includes a body 67 through which there is an upper and lower elongated circular passage 68 and 69 which run parallel to the longitudinal axis of the pump. Each passage is divided in two portions, a rear sleeve bearing support portion 70 and 71 and a front piston portion 72 and 73. The piston portion has a greater diameter than the adjacent sleeve bearing portion. A vertical surface formed at the interface of the larger diameter piston portion and smaller diameter sleeve bearing support portion has a flat outer peripheral wall 74 and 75 and two inner converging rings 76, 77, 78, and 79.

The upper piston portion is connected to a common fluid return system by passageway 80 which opens into the upper piston portion at the bottom of vertical wall 74. The lower piston portion is connected by passageway 81 which opens into the lower piston portion at the top of the vertical wall 75. These two short passageways 80 and 81 allow bypass fluid to flow to the rear of the sleeve bearing support portion by vertical slot 83 which is connected with the rear of the first common passageway 82. From the first common passageway 82, there is second common passageway 84 which runs perpendicular to passageway 82 and intersects the outer surface of the body where it is sealed with a removable plug provided for cleaning. A third common passageway 85 intersects the passageway 84 at a right angle and has its rear end intersecting the outer surface where it is sealed with a removable plug. The front end of the passageway 85 intersects the suction intake means of the pump.

With graphite sleeve bearings 86 and 87 disposed in the sleeve bearing support portions 70 and 71 respectively, the rear ends of the drive and driven screw assembly are rotatably disposed and supported in the respective sleeve bearings. The graphite pistons 17, 18 become disposed in the piston portion of the upper and lower passage with a tightly controlled tolerance which in a typical pump would be in the order of from about 0.004–0.008 inches. Each piston has two sealing grooves 88 in its outer circumferent surface which help to insure a continuous flow in this area. The fluid which does by-pass the pistons collects in the areas 90 and 91 behind each piston and then is returned to the suction inlet through passageways 80 and 81 which merge in passageway 82 and then return through passageways 84 and 85. Of the total pressure drop in the by-pass fluid—equal to the difference between the outlet and inlet fluid pressure—a substantial portion occurs as the fluid by-passes the outer circumferent surface of the piston. This pressure differential acting on the rear face of the piston results in a force which partially resists the resultant axial thrust on screw assemblies.

During operation, a rotation means is engaged with the drive screw assembly 11. The driven screw assembly 12 in turn is rotated by the engagement of timing gear 16 with timing gear 15.

The counterflow movement of the driven screw assembly 12 is fixed by the interfering of the front vertical surface of the timing gear 16 with the thrust bearing 41 which in turn is limited by the vertical wall 39.

The counterflow movement of the drive screw assembly 11 can be selectively adjusted by the rotation of the timing cartridge 42 which is threaded into the upper inner passage 31 of the front head assembly. By selective adjustment, the clearance 92 between the respective drive screw components can be adjusted so as to balance the resultant axial thrust on each screw assembly while the pump is being operated under a load.

The maximum in-flow adjustment is limited to the interference of stop 49 on the cartridge with stop 35 in the upper passage of the front head assembly.

While various modifications may be suggested by those versed in the art, it should be appreciated that I wish to embody within the scope of the patent warranted hereon all such modifications as reasonably and properly come within the scope of my contribution to the art.

I claim as my invention:

1. In a pump having a front head assembly, a rear head assembly, and dual screw pumping parts comprising, a drive screw having a shaft, a driven screw having a shaft, means mounting said dual screw pumping parts for floating intermeshed rotation and providing an inlet and an outlet for pressurizing a pumping medium, cylinder means at one end of the dual screw pumping parts, piston means received in said cylinder means for axial movement relative to said screws and having pistons engageable with corresponding said screws to adjust the relative longitudinal position of said screws, pressure loading means for axially loading said pistons as a function of a pressure differential acting on said screws, a timing cartridge at an opposite axial end of said screws, said timing cartridge being rotatably adjustable and having a movable element shiftable in an axial direction relative to said screw pumping parts, means interfacng one of said screw pumping parts and said movable element to selectively adjust the position of said one screw pumping part to obtain a balance of the resultant axial thrust on the screw pumping parts, said drive and driven screw further comprising, said rear end of each said shaft prepared for disposition in a sleeve bearing in said rear head assembly, said front end of said shaft prepared for disposition in a sleeve bearing in said front head assembly, each said piston having an outer circular surface and a front and rear vertical surface, said outer circular surface having at least one circumferent sealing groove, said outer surface prepared for disposition into a piston portion in the rear head assembly with a by-pass fit, said timing cartridge prepared for engagement with a timing gear on said drive screw.

2. In a pump as defined in claim 1, said rear head assembly comprising:

a housing body having two inner elongated passages through said body, each said passage being divided into a bearing support portion and a piston portion, and a fluid return means connecting the piston portion with the suction means of said pump, and at least two support bearings, one each of said bearings disposed in said bearing support portions, said inner, elongated passages disposed in a vertical relationship and defining an upper and lower passage, said passages being divided into a rear sleeve bearing support portion and a front piston portion, said sleeve bearing support portion having a circular wall and prepared for the disposition of a sleeve bearing, said front portion having a circular wall with a greater circumferent dimension than said sleeve bearing support portion and prepared for the disposition of a piston with a by-pass fit, a vertical wall being formed at the rear of the piston portion at the interface of said sleeve bearing support portion and said piston portion, a fluid return system comprised of five elongated circular interconnecting passageways, an end of said passageway one and of passageway two intersecting the piston portion at the vertical wall at the bottom and top of the upper and lower piston portion, respectively, the other ends of said passageways one and two intersecting with a first common passageway at a front end, said first common passageway running parallel to the longitudinal axis of the pump and positioned between the upper and lower sleeve bearing support portions, said rear end of the first common passageway intersecting with a vertical slot, said vertical slot connecting with the rear end of said sleeve bearing support portions, a second common passage, said passageway having one end intersecting said first common passageway at a right angle near the front end of said first common passageway and the other end of second common passageway intersecting the rear head body outer surface, said other end prepared for a removable sealing means, a third common passageway, said passageway running parallel to the first common passageway, an end of said third common passageway intersecting the rear head body outer surface, said end prepared for a removable sealing means, said third common passageway intersecting said second common passageway adjacent to the outer surface end, said other end of said third common passageway intersecting with the intake suction means of the pump, said bearings being sleeve bearings having an outer circular surface prepared for disposition in the bearing support portions respectively and an inner circular surface prpared for the rotational disposition of the rear end of drive and driven screw assemblies respectively, said bearings disposed in said upper and lower bearing support portion respectively.

3. In a dual screw-type pump a counterflow dynamic axial thrust adjustment assembly having a front head assembly comprising:

a housing body having two inner elongated horizontal passages, one said passage forming a timing cartridge support area and the other said passage forming a bearing support area said passages being vertically aligned with said lower bearing support area disposed below said upper timing cartridge support area, said bearing support area having a circular wall and being divided into a front and rear portion, said front portion prepared to receive a sleeve bearing and having a lesser circumferent dimension than said rear portion, said rear portion prepared to receive a thrust bearing, and a vertical wall being formed at the rear of said front portion at the interface of said front portion and rear portion, said wall forming a stop for said thrust bearing, a first sleeve bearing having an outer circular surface prepared for disposition in said front portion and an inner circular surface prepared for the rotatable disposition of a front end of a shaft of a driven screw assembly of said pump, said bearing being disposed in said front portion, a first thrust bearing having an outer circular surface prepared for disposition in said rear portion and an inner circular surface prepared for the rotatable disposition of said front end of said shaft, a front vertical surface prepared to interface with said vertical wall, and a rear vertical surface prepared for engagement with a rotation means carried by said shaft, said bearing disposed in said rear portion and said front vertical surface in contact with said wall, said timing cartridge support area being divided in a front and rear portion, said rear portion having a smooth circular wall prepared for the slidable disposition of a thrust bearing and a timing cardtridge, said front portion having a circular wall and being divided into a rear set-screw section and a front threaded section, and having a greater circumferent dimension than said rear portion, a vertical wall being formed at the rear of said front portion at the interface of said front and rear portions and forming a stop adjacent to said adjoining set-screw section, said threaded section being adjacent to and to the front of said set-screw section and prepared to receive a timing cartridge in threaded assembly, said housing body having a threaded circular passage running perpendicular to the longitudinal axis of said pump at the center line of said timing cartridge support area and intersecting an outer surface of said housing body and said set-screw section of said timing cartridge support area, a set-screw, said screw disposed in said passage, a second thrust bearing having an outer circular surface prepared for and disposed in said rear portion of the timing cartridge support area, an inner circular surface prepared for the rotatable disposition of a front end of a shaft of a drive screw assembly of said pump, said bearing having front and rear vertical surfaces, said rear surface prepared to engage with a rotation means carried by said drive shaft, said front vertical surface prepared to interface with a timing cartridge, said bearing disposed in said rear portion of said timing cartridge support area, and a longitudinally adjustable timing cartridge assembly means threadedly disposed in said support area.

4. In a dual screw-type pump a counterflow dynamic axial thrust adjustment assembly comprising:

a front head assembly means attached to the front of said pump, a longitudinal adjustable timing cartridge assembly means disposed in said front head assembly and more particularly characterized by said cartridge, comprising:

an elongated cartridge body having an inner passage extending through said body, said inner passage divided into a rear bearing support portion, a middle stop portion, and a front sealing portion, said bearing support portion having a circular wall and prepared for the disposition of a sleeve bearing, said stop portion adjacent to and to the front of the bearing support portion being defined by a circular wall having a lesser circumferent dimension than said bearing support portion, said sealing support portion being adjacent to and to the front of the stop portion being defined by a circular wall having a greater circumferent dimension than said stop portion, a vertical wall being formed at the rear of the bearing support portion and at the front of the sealing support portion at the interface of said center portion with the respective other portions, said walls defining stops, said cartridge body having an outer circular surface, said outer surface being divided into a rear portion, a middle portion and a front portion, said rear portion being circular and having a circumferent slot, said slot prepared for the disposition of an O-ring, said portion prepared for the slideable disposition in a rear portion of a timing cartridge support area, said center portion divided into a set-screw section, a threaded section, and a lubrication section, said set-screw section being adjacent to and to the front of the rear portion and having a circular body, said body having a greater circumferent dimension than said rear portion, a vertical wall being formed at the rear of the set-screw section at the interface of the set-screw section and the rear portion, said vertical wall defining a stop, said thread section adjacent to and to the front of the set-screw section, said section prepared for threaded assembly in a timing cartridge support threaded section in said front head assembly, said lubrication section adjacent to and to the front of said threaded section, said section having a circular surface being traversed by four elongated, circular passages disposed, one each at 90° intervals about the outer surface, said passages being concentrically aligned and axially converging and intersecting the sealing support portion of the inner passage, said passages having outer ends prepared for a removable sealing means, said front portion having a tool rotation portion, said portion having an outer circular surface and a front vertical face, said outer surface having at least one tool-engagement slot, a sleeve bearing having an outer circular surface prepared for disposition in said bearing support portion and inner circular surface prepared for the rotational disposition of a front end of a drive screw assembly for said pump, said bearing disposed in the said bearing support portion.

5. In a dual screw-type pump as defined in claim 4, and further including the sealing means comprising:

a cylindrical fibrous packing material having an outer circular surface prepared for disposition in the sealing portion, and an inner circular surface prepared for the rotational disposition of the front end of the drive screw assembly, a lantern ring, said ring having an outer circular surface prepared for disposition in the sealing portion, and an inner circular surface prepared for the rotational disposition of the front end of the drive screw assembly, said packing material comprising a first and a second portion, said first portion being disposed in the rear of the sealing support portion, said lantern ring being disposed in said sealing support portion and aligned with said four passages, said second packing portion being disposed adjacent to and to the front of said lantern ring, a retaining ring, said ring removably attached to the vertical face of the tool rotation portion, said packing and lantern ring fixed in location between said stop portion and said retaining gland.

6. In a dual screw-type pump used to pump high density and/or fluid containing suspended solids provided with a counter-flow dynamic axial thrust adjustment assembly comprising:

a. a rear head assembly means attached to the rear of said pump, more particularly characterized as comprising:

a housing body having two inner, horizontal, elongated passages vertically aligned through said body, each of said passages having a circular wall and being divided into a rear bearing support portion and front piston portion, said sleeve bearing support portion prepared to receive a sleeve bearing and said front piston portion prepared to receive a piston with a bypass fit and having a greater circumferent dimension than said sleeve bearing support portion, a vertical wall being formed at the rear of the piston portion at the interface of said sleeve bearing support portion and said piston portion, said wall having a plurality of concentrically formed saucer-shaped rings converging radially and increasing in depth as said wall interfaces with said bearing support portion, a fluid return system having a first and second passageway and a first, second and third common passageway, said first and second passageway having an end intersecting with the vertical wall of the piston portion at the bottom and the top of the upper and lower piston portions respectively and having the other ends respectively intersecting with a front portion of said first common passageway, said first common passageway being parallel to the longitudinal axis of the pump and positioned between the upper and lower sleeve bearing support portions and having a rear portion intersecting with a vertical slot, said vertical slot connecting with a rear section of said sleeve bearing support portions respectively, a second common passage, said passageway having an inner end intersecting said first common passageway at a right angle at the front portion of said first common passageway and an outer end intersecting with an outer surface of said housing body, said outer end prepared for and receiving therein a removable sealing means, a third common passageway aligned parallel to the first common passageway and having an outer end intersecting the outer surface of said housing body, said outer end prepared for and receiving therein a removable sealing means, said third common passageway intersecting said second common passageway adjacent to the outer end of said second common passageway, said inner end of said third common passageway intersecting with an intake suction means of the pump, a first and second sleeve bearing having an outer circular surface prepared for disposition in the bearing support portions respectively and an inner circular surface prepared for the rotational disposition of a rear end portion of a drive and driven screw shaft assembly respectively, said bearing disposed in said upper and lower bearing support portion respectively, b. a driven screw assembly carried by said pump comprising:

an elongated shaft having a rear end portion prepared for disposition in said sleeve bearing, and a piston having an outer circular surface and a front and rear vertical surface, said outer circular surface having at least one circumferent sealing groove, said piston prepared for disposition in said piston portion in said rear head assembly with a bypass fit, said piston prepared for and disposed adajcent to the rear end portion of said shaft in a fixed position, and said end portion of said shaft being disposed in said lower sleeve bearing, and c. a drive screw assembly carried by said pump comprising:

an elongated shaft having a rear end portion prepared for disposition in said sleeve bearing, and a piston having an outer circular surface and a front and rear vertical surface, said outer circular surface having at least one circumferent sealing groove, said piston prepared for disposition in said piston portion in said rear head assembly with a by-pass it, said piston prepared for and disposed adjacent to the rear end portion of said shaft in a fixed position, and said end portion of said shaft being disposed in said upper sleeve bearing.

7. In a dual screw-type pump, a counterflow dynamic axial thrust adjustment assembly comprising:

a. a front head assembly means attached to the front of said pump, b. a longitudinally adjustable timing cartridge assembly means disposed in said front head assembly, c. a rear head assembly means attached to the rear of said pump, d. a driven screw assembly means, one end of said screw assembly disposed in said rear head assembly, the other end of said screw assembly disposed in said front head assembly, e. a driving screw assembly means, one end of said driving screw assembly disposed in said rear head assembly, the other end of said driving screw assembly engaging said timing cartridge, f. a driving means, said driving means rotatively connected to an end of the driving screw at the front end of the pump, whereby adjustment of said timing cartridge assembly means will position said driving screw in selected longitudinal alignment relative to said driven screw, said front head assembly comprising:

a housing body having two inner elongated passages, one said passage forming a timing cartridge support area, and the other said passage forming a bearing support area, a support bearing disposed in said bearing support area, and at least two thrust bearings, one being disposed in said timing cartridge support area and the other being disposed in said bearing support area, said inner-elongated passages of said housing body being disposed vertically with said lower bearing support area disposed below said upper timing cartridge support area, said bearing support area of said housing body having a circular wall and being divided into a front and rear portion, said front portion having a sleeve bearing and having a lesser circumferent dimension than said rear portion, a vertical wall being formed at the rear of said front portion at the interface of said front portion and rear portion, said wall forming a stop, and said rear portion receiving a thrust bearing, said timing cartridge support area being divided into a front and a rear portion, said rear portion of said timing cartridge support area having a smooth circular wall and slidably receiving said thrust bearing and said timing cartridge, said front portion of said timing cartridge support area having a circular wall and being divided into a rear setscrew section and a front threaded section, and having a greater circumferent dimension than said rear portion, a vertical wall being formed at the rear of said front portion at the interface of said front and rear portions and forming a stop engageable with said adjoining set-screw section, said threaded section being adjacent to and to the front of said set-screw section and receiving said timing cartridge in threaded assembly, said housing body having a threaded circular passage running perpendicular to the longitudinal axis of said pump at the center line of said housing body and intersecting an outer surface of said housing body and said set-screw section of said upper inner passage, a set-screw in said passage, said bearing being a sleeve bearing having an outer circular surface prepared for disposition in said bearing support portion, and an inner circular surface prepared for the rotational disposition of the front end of the driven screw shaft, said bearing disposed in said bearing support portion, said thrust bearings having an outer circular surface received in the rear portion of the timing cartridge support area, and said rear portion of said lower passage respectively, an inner circular surface rotatably received in the front end of the drive and driven screw shafts, said bearings each having a front and rear vertical surface, said rear surfaces engageable with said rotation means of said screw assemblies, said front surface engageable with said timing cartridge and with said vertical wall of said lower passage respectively.

8. In a dual screw-type pump, a counterflow dynamic axial thrust adjustment assembly comprising:

a. a front head assembly means attached to the front of said pump, b. a longitudinally adjustable timing cartridge assembly means disposed in said front head assembly, c. a rear head assembly means attached to the rear of said pump, d. a driven screw assembly means, one end of said screw assembly disposed in said rear head assembly, the other end of said screw assembly disposed in said front head assembly, e. a driving screw assembly means, one end of said driving screw assembly disposed in said rear head assembly, the other end of said driving screw assembly engaging said timing cartridge, f. a driving means, said driving means rotatively connected to an end of the driving screw at the front end of the pump, whereby adjustment of said timing cartridge assembly means will position said driving screw in selected longitudinal alignment relative to said driven screw, said timing cartridge assembly comprising:

a cartridge body of elongated configuration and having an inner passage extending through said body, said inner passage divided into a bearing support portion and a sealing support portion, a support bearing disposed in said bearing support portion, and a sealing means disposed in said sealing support portion, said inner passage divided into a rear bearing support portion, a middle stop portion, and a front sealing portion, said bearing support portion having a circular wall and prepared for the disposition of a sleeve bearing, said stop portion adjacent to and to the front of the bearing support portion being defined by a circular wall having a lesser circumferent dimension than said bearing support portion, said sealing support portion being adjacent to and to the front of the stop portion being defined by a circular wall having a greater circumferent dimension than said stop portion, a vertical wall being formed at the rear of the bearing support portion and at the front of the sealing support portion at the interface of said center portion with the respective other portion, said walls defining stops, said cartridge body having an outer circular surface, said body being divided into a rear portion, a middle portion and a front portion, said rear portion being circular and having a circumferent slot, said slot prepared for the disposition of an 0-ring, said portion prepared for the slidable disposition in the rear portion of a timing cartridge support area, said center portion divided into three sections, a set-screw section, a threaded section, and a lubrication section, said set-screw section being adjacent to and to the front of the rear portion and having a circular body, said body having a greater circumferent dimension than said rear portion, a vertical wall being formed at the rear of the set-screw section at the interface of the set-screw section and the rear portion, said vertical wall defining a stop, said thread section adjacent to and to the front of the set-screw section, said section prepared for being threaded into the timing cartridge support threaded section, said lubrication section adjacent to and to the front of said threaded section, said section having a circular surface, said surface being traversed by four elongated, circular passages disposed, one each at 90° intervals about the outer surface, said passages being concentrically aligned and axially converging, said passages intersecting the sealing support portion of the inner passage, said outer ends of said passages prepared for a removable sealing means, said front portion defining a tool rotation portion, said portion having an outer circular surface and a front vertical face, said outer surface having at least one tool-engagement slot, said bearing being a sleeve bearing and having an outer circular surface prepared for disposition in said bearing support portion and inner circular surface prepared for the rotational disposition of the front end of the drive screw assembly, said bearing disposed in the said bearing support portion.

9. A timing cartridge according to claim 8 and further including the sealing means comprising:

a cylindrical fibrous packing material having an outer circular surface prepared for disposition in the sealing portion, and an inner circular surface prepared for the rotational disposition of the front end of the drive screw assembly, a lantern ring, said ring having an outer circular surface prepared for disposition in the sealing portion, and an inner circular surface prepared for the rotational disposition of the front end of the drive screw assembly, said packing material being divided into two portions, one portion being disposed in the rear of the sealing support portion, said lantern ring being disposed in said sealing support portion and aligned with said four passages, said second packing portion being disposed adjacent to and to the front of said lantern ring, a retaining gland ring, said ring removably attached to the vertical face of the tool rotation portion, said packing and lantern ring fixed in location between said stop portion and said retaining gland.

* * * * *